US009767623B2

(12) United States Patent
Schindler et al.

(10) Patent No.: US 9,767,623 B2
(45) Date of Patent: Sep. 19, 2017

(54) PCMCIA CARD FOR TRANSFERRING FLIGHT DATA

(71) Applicant: Sagem Defense Securite, Boulogne-Billancourt (FR)

(72) Inventors: Sonia Schindler, Boulogne-Billancourt (FR); Denis Delville, Boulogne-Billancourt (FR); Patrick Valette, Boulogne-Billancourt (FR)

(73) Assignee: SAGEM DEFENSE SECURITE, Boulogne-Billancourt (FR)

( * ) Notice: Subject to any disclaimer, the term of this patent is extended or adjusted under 35 U.S.C. 154(b) by 0 days.

(21) Appl. No.: 14/437,818

(22) PCT Filed: Oct. 23, 2013

(86) PCT No.: PCT/EP2013/072204
§ 371 (c)(1),
(2) Date: Apr. 22, 2015

(87) PCT Pub. No.: WO2014/064167
PCT Pub. Date: May 1, 2014

(65) Prior Publication Data

US 2015/0279126 A1 Oct. 1, 2015

(30) Foreign Application Priority Data

Oct. 23, 2012 (FR) ..... 12 60092

(51) Int. Cl.
*G07C 5/00* (2006.01)
*G07C 5/08* (2006.01)
*G08G 5/00* (2006.01)

(52) U.S. Cl.
CPC ..... *G07C 5/008* (2013.01); *G07C 5/0858* (2013.01); *G08G 5/0013* (2013.01); *G08G 5/0021* (2013.01)

(58) Field of Classification Search
USPC ..... 701/33
See application file for complete search history.

(56) References Cited

U.S. PATENT DOCUMENTS 6,915,189 B2 * 7/2005 Igloi ..... B64F 5/60 701/14
7,007,024 B2 * 2/2006 Zelenka ..... G06F 17/30607 707/741
7,007,047 B2 * 2/2006 Zelenka ..... G06F 17/30088
7,036,039 B2 * 4/2006 Holland ..... G06F 11/1464 714/4.11

(Continued)

FOREIGN PATENT DOCUMENTS

EP 1021021 A2 * 7/2000 ..... H04L 29/06
WO WO-01/60693 8/2001

(Continued)

*Primary Examiner* — Jean-Paul Cass
(74) *Attorney, Agent, or Firm* — Blakely Sokoloff Taylor & Zafman LLP

(57) ABSTRACT

The invention concerns a PCMCIA card for downloading flight data remotely via a wireless network to a ground station, the PCMCIA card being designed to be connected to an ACMS system of an aircraft, the ACMS system being designed to generate an ACMS report after at least one predefined condition has been satisfied, and to record flight data.

9 Claims, 2 Drawing Sheets

(56) References Cited

U.S. PATENT DOCUMENTS

| | | | | |
|---|---|---|---|---|
| 2003/0041283 | A1* | 2/2003 | Murphy | G06F 11/2094 714/13 |
| 2005/0026609 | A1* | 2/2005 | Brinkley | G06F 8/61 455/431 |
| 2005/0228559 | A1* | 10/2005 | Bloch | G07C 5/008 701/3 |
| 2007/0260770 | A1 | 11/2007 | Walsch et al. | |
| 2012/0131116 | A1* | 5/2012 | Tu | H04L 63/101 709/206 |

FOREIGN PATENT DOCUMENTS

| | | | |
|---|---|---|---|
| WO | WO 01/60693 | A2 | 8/2001 |
| WO | WO-2005/101283 | | 10/2005 |
| WO | WO 2005/101283 | A2 | 10/2005 |
| WO | WO-2005/101284 | | 10/2005 |
| WO | WO 2005/101284 | A2 | 10/2005 |

* cited by examiner

PCMCIA CARD FOR TRANSFERRING FLIGHT DATA

GENERAL TECHNICAL FIELD

The invention relates to aircraft condition monitoring systems (ACMS) and more particularly to the transmission of flight data from such a system for the analysis thereof.

STATE OF THE ART

The ACMS systems allow to record and monitor flight data and pieces of information from aircraft systems and equipments. These data are required to set flight reports intended for the flight safety officers, and they can also be analysed to improve the plane's performance and optimize their lifetimes. These flight data have to be analysed on a regular basis for regulation and maintenance reasons.

An ACMS system is conventionally interfaced with other on-board equipment in the aircraft.

An ACMS system acquires, during the flight, data from several devices, for example sensors, provided in the aircraft, but also from on-board computers. The recorded data are transmitted to a flight data recorder (FDR) which stores the data. In parallel, the ACMS system also stores in its mass memory a copy (either strictly identical, or modified, that is data having undergone pre-processings) of the data of this record. The ACMS system further enables ACMS reports to be generated, for example at take-off or during the enroute phase. These reports are parametrized as a function of the aircraft manufacturer demands and needs.

These records and ACMS reports are the ones which have to be retrieved and analysed on a regular basis, in accordance with the regulation.

To retrieve these records and ACMS reports, a PCMCIA (Personal Computer Memory Card International Association) card is connected to the ACMS system. It is used as a removable mass memory. Until now, this PCMCIA card was only carried out the storage of these records and reports. It is necessary that an operator boards the aircraft on a regular basis to exchange this card and thus retrieve the data.

Document WO 2005/101283 A1 describes a system and a method for interfacing a wireless network with an ACMS system in order to download flight data remotely. The invention is within this context and provides an improvement of such a system.

DISCLOSURE OF THE INVENTION

To that end, the invention provides a PCMCIA card for downloading flight data remotely via a wireless network to a ground station, the PCMCIA card being designed to be connected to an ACMS system of an aircraft, the ACMS system being designed to generate an ACMS report after at least one predefined condition has been satisfied, the ACMS report comprising several pieces of information, and to record flight data, the PCMCIA card comprising

- a communication unit designed to transfer data to the ground station, the communication unit comprising a transmitter;
- a storage unit connected to the communication unit, the storage unit being designed to store flight data, an ACMS report;
- the device being characterised in that
- the storage unit is designed to further store a set of configuration data of the flight data transfer; and in that the PCMCIA card further comprises

- a communication control unit designed to inhibit the transmitter of the communication unit under some conditions;
- the communication unit comprises a processor to detect whether an ACMS report has been generated, compare the pieces of information of the ACMS report to configuration data and depending on the comparison, automatically trigger the flight data transfer, depending on transfer parameters of the configuration data, to the ground station; and in that
- the communication unit is designed to receive, via the wireless network, a request to trigger the flight data transfer if an ACMS report has been generated.

The invention is advantageously completed by the following characteristics, taken alone or in any of their technically possible combinations:

- the communication unit automatically triggers the flight data transfer as soon as at least one piece of information of the ACMS report is identical to a configuration datum;
- the communication unit automatically triggers the flight data transfer as soon as an inclusive or exclusive combination of pieces of information of said ACMS report is identical to a combination of configuration data;
- the PCMCIA card further comprises a unit for managing access to the storage unit of the PCMCIA card by the processor of the communication unit on the one hand and the ACMS system on the other hand;
- the access to the storage unit is configured according to the ATA standard and wherein at each permutation of the access to the storage unit, the management unit conducts a context restitution of the ATA registries in the storage unit;
- the configuration data are: a list of possible wireless network and/or a list of possible airports and/or a list of flight data to be transferred and/or a compression rate to be applied to the flight data and/or an encryption type to be applied to the flight data and/or a roaming activation;
- the flight data are deleted from the storage unit after their automatic transfer;
- the wireless network is a cellular network or a dedicated architecture mobile network of the IEEE 802.11 or IEEE 802.16 Wi-Fi type;
- the wireless network is a cellular network and wherein, as an alternative to the automatic transfer at the end of the flight, it is possible to trigger a transfer by the receipt of a SMS message or equivalent;
- the communication control unit is designed to receive from the ACMS system at least one flight datum in order to determine whether the transmitter of the communication unit has to be inhibited;
- it comprises an interface designed to connect said PCMCIA card to an ACMS system (11) of an aircraft, the interface being a PCMCIA, USB, PCI, PCI express interface.

The PCMCIA card of the invention is readily integrated in an avionic box positioned in an aircraft and does not require further antenna(s) and facility(ies), since the PCMCIA card comprises all these functions.

This PCMCIA card comprises, beside a memory to store the records and ACMS reports, a wireless network interface to allow connection of the ACMS system to a wireless network (of the Wi-Fi IEEE 802.11 type) or cellular network (2G, 3G, or 4G according to the availability of the operator chosen) and thus allow retrieval of the records and the ACMS reports remotely automatically and without human intervention. Thus, records and ACMS reports are automatically securely transmitted to a dedicated ground station and can be analysed.

DESCRIPTION OF THE FIGURES

Further characteristics, purposes and advantages of the invention will appear from the description that follows, which is purely illustrative and non-limiting, and which should be read with regard to the appended drawings on which.

Throughout the figures, similar elements bear identical reference numerals.

DETAILED DESCRIPTION OF THE INVENTION

Figure 1:
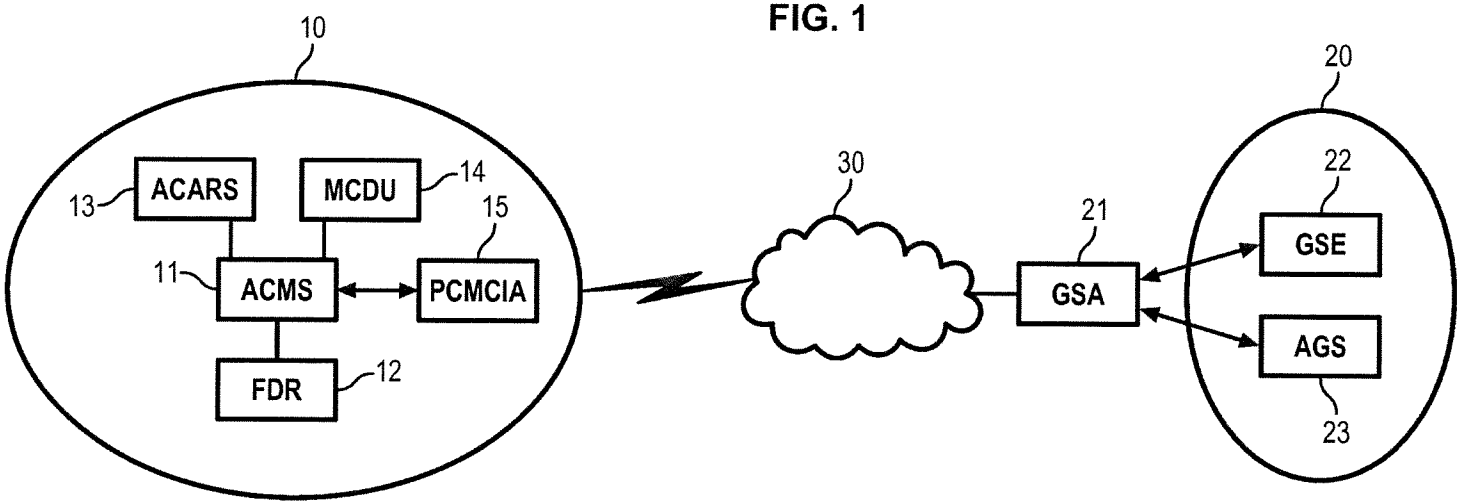
FIG. 1 illustrates a system for downloading flight data in accordance with an embodiment of the invention.
Figure 2:
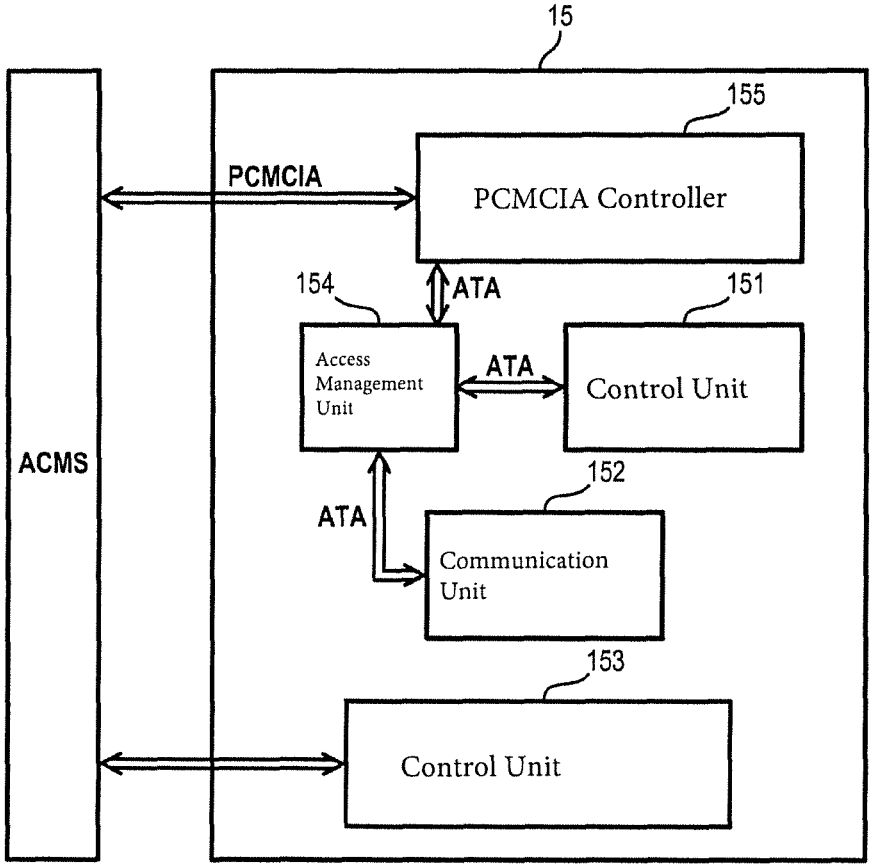
FIG. 2 illustrates a PCMCIA card in accordance with an embodiment of the invention.

In relation with FIG. 1, a system for downloading flight data comprises a device 10 on-board an aircraft and a ground station 20.

The ground station 20 is connected to a ground service application (GSA) station 21 itself connected to a wireless network 30 to access the device on-board the aircraft.

The ground station 20 can include a ground support equipment (GSE) 22 and an analysis ground station (AGS) 23.

The GSA station 21 allows to receive flight data from the device 10 on-board the aircraft and to transmit them to the GSE equipment 22, to the AGS station 23.

The GSE equipment 22 allows to control the system for downloading flight data and the analysis station AGS 23 allows to analyse the flight data.

By its generic character, this means allows to communicate with any other equipment linked with various maintenance fields of the aircraft such as on-board systems, engines, gears, performance, . . . .

The wireless network 30 can be a GSM, GPRS, EDGE, UMTS, HSDPA, HSPA+ type cellular network or a Wi-Fi IEEE 802.11 or IEEE 802.16 type dedicated architecture mobile network. These communication means are not exclusive, other protocols and frequency bands can be used, depending on the evolutions of the consumer communications market. To that end, the system is designed to automatically detect the wireless network available with the best bit rate.

The device on-board the aircraft comprises an ACMS system 11. The ACMS system allows to acquire flight data from several sensors provided in the aircraft. The ACMS system enables records and ACMS reports to be generated.

The acquired flight data are transmitted to a flight data recorder FDR 12 and can be transmitted to a monitor system 13 (Aircraft Communication And Reporting System, (ACARS)).

Further, the flight data can be transmitted to the pilot and/or maintenance staff to deliver information during the flight and/or in maintenance phase through a display system 14 (Multifunction Condition and Display Unit, (MCDU)) located in the aircraft cockpit.

To allow the flight data transfer, the ACMS system 11 is connected to the wireless network 30 via a PCMCIA card 15 connected to a PCMCIA port (not represented) of the ACMS system 11. Of course, the PCMCIA interface is an example, but other interfaces, such as USB, PCI, PCI express or other, could be used.

Thus, the PCMCIA card comprises an interface (not represented) designed to connect the PCMCIA card to the ACMS system 11; the interface can be a PCMCIA, USB, PCI, PCI express interface.

The PCMCIA card comprises a storage unit 151 for storing the flight data records as well as ACMS reports.

The PCMCIA card comprises a communication unit 152 comprising all the functionalities to ensure a wireless connection with the wireless network (antenna, power control, etc.).

The PCMCIA card comprises a control unit 153 programmed to authorise or forbid that a wireless connection is set by the communication unit 152. In other words, under some conditions, the control unit 153 enables the transmitter of the communication unit 152 to be inhibited.

Such a ban should for example intervene when the aircraft is in flight, taxiing, in take-off or landing phase. Indeed, setting a connection under these circumstances could result in being detrimental to equipments necessary for a proper operation of the aircraft during these phases.

To determine whether the transmitter has to be inhibited, the control unit 153 receives at least one flight datum from the ACMS system. It is necessary, for safety reasons, to confirm by several pieces of information the transmission authorization.

The communication unit 152 comprises a processor programmed to ensure the management of the flight data transfer. Such a management is the retrieval of the flight data from the storage unit and a transfer triggering.

The PCMCIA card enables flight data to be transferred after an ACMS report has been generated. Such an ACMS report is generated after at least one predefined condition has been satisfied.

For example, the ACMS report is generated after the aircraft has landed. Thus, the conditions to be satisfied can be: the opening of the aircraft doors, a zero speed of the aircraft, a zero fuel flow rate, etc. All these conditions are configurable.

Those skilled in the art can contemplate other conditions to implement the generation of the ACMS report.

This ACMS report comprises among other things a number of information: aircraft location, date, flight number, aircraft series number. These pieces of information are configurable.

Thus, the ACMS report enables a set of information to be known at each landing of the aircraft.

Once it is generated, this ACMS report is stored in the storage unit 151.

The storage unit 151 also comprises a set of configuration data. These configuration data enable a flight data transfer policy as well as parameters relating to the actual transfer of the flight data to be defined.

These configuration data are for example:

- a list of possible wireless networks: only the networks of the list can be used;
- a list of possible airports: the data will be downloaded only in some airports;
- a compression rate to be applied to the flight data;
- an encryption type to be applied or not; in some countries, data encryption is not authorized;
- a roaming activation: for economic reasons, the roaming cannot be activated:
- the type of data to be downloaded: it is not necessary to download the same data at each time.

Of course, other configuration data can be defined.

These configuration data correspond to a choice of an airline and offer a flexible use of the system depending on the needs.

According to one embodiment, once the report is generated, the communication unit detects the generation of this ACMS report. Such a detection is followed by a comparison of the information contained in the ACMS report to the configuration data.

The comparison result is mainly a decision relating to the automatic triggering of the flight data transfer to the ground station.

A comparison is, for example, whether at least one piece of information of the ACMS report is identical to a configuration datum (for example, the aircraft is located in an airport in which the data have to be downloaded), the processor of the communication unit will automatically download flight data in accordance with the configuration data.

Another comparison can consist in comparing an inclusive ("logical AND") or exclusive ("logical OR") combination of information of the ACMS report with respect to the configuration data.

In that case, the processor will initialize downloading the flight data as a function of the configuration data: choice of the wireless network, compression rate, etc.

Of course, downloading the flight data is only possible if the communication control unit has not inhibited the communication unit transmitter.

According to another embodiment, the communication unit 152 can receive, via the wireless network 30, a request to trigger the flight data transfer.

This request allows to trigger the flight data transfer independently of the automatic download and can comprise transfer initialization data for, for example, retrieving some type of data even if it is not provided for in the configuration data stored in the storage unit.

Triggering the downloading upon request allows to ensure that the flight data can be retrieved. It overcomes, for example, a human error upon creating configuration data. It further allows an exceptional retrieval going beyond the comparison of the ACMS reports and the configuration data previously described.

Such a request can, in the case of a cellular network, be a SMS parameterized under some conditions.

Once again, downloading the flight data is only possible if the communication control unit has not inhibited the transmitter of the communication unit. The PCMCIA card comprises a unit 154 for managing the access to the storage unit 151, on the one hand by the processor of the communication unit 152 and on the other hand by the ACMS system via the PCMCIA controller 155.

The PCMCIA card comprises a PCMCIA controller 155 to interface the ACMS system with the components of the PCMCIA card.

The management unit 154 is connected to the ACMS system via the PCMCIA controller 155.

The connection between the management unit 154 and the PCMCIA controller 155 is carried out by means of a so-called "ATA" (Advanced Technology Attachment) standard connection bus. It is to be noted that this so-called "ATA" standard connection bus is also known as "IDE" (Integrated Drive Electronics). This is also an ATA bus which connects the storage unit 151 to the management unit 154 on the one hand and to the communication unit 152 on the other hand.

It is noted that the use of an ATA bus also implies an access method according to this standards.

In particular, the accesses to the storage unit 151 are in accordance with the ATA standard.

The unit 154 for managing the access to the storage unit 151 enables the access conflicts between the ACMS system and the processor of the communication unit 152 to be managed.

Thus, the access management unit 154 enables reading and writing of the storage unit 151 to be paralleled. Indeed, the access management unit 154 will allow both the communication unit 152 to read the data present in the storage unit 151 without disturbing writing by the ACMS system, which writing comes via the PCMCIA controller 155.

Indeed, in the case where a writing request from the PCMCIA controller 155, and a reading request by the transmission unit 151 occur simultaneously, the access management unit 154 will allocate and sequence both orders, giving priority to the PCMCIA controller 155.

Thus, at each permutation of the access to the storage unit, the management unit conducts a context restitution of the ATA registries in the storage unit.

In particular, eight ATA registries are saved and restored at each permutation of the master on the storage unit, the master being alternatively either the processor of the communication unit 152, or the ACMS system through the PCMCIA controller 155.

These registries are the following ones (from the ATA standard): Feature, Sector Count, Sector Number, Cylinder Low, Cylinder High, Drive/Head, Command and Device Control.

These registries correspond to the address, access type (reading/writing), that the ACMS system through the PCMCIA controller 155 or the processor of the communication unit 152 desires to do on the storage unit.

It is noted that an update of this information at each new access is not planned in the ATA standard.

Without this restitution by the access management unit 154, the ACMS system and the processor of the communication unit 152 would be forced to provide this information before each access to replace the storage unit within the context of the current master. For this, a modification of the softwares of the ACMS and of the processor of the unit 152 is essential. Otherwise, the errors would be:

- upon reading by the processor of the unit 152: undetectable erroneous readings
- upon writing by the ACMS system, via the PCMCIA controller 155: undetectable erroneous writings, violation of the integrity of the existing data, violation of the integrity of the storage unit format.

The use of such a management unit is totally transparent, unlike a solution which would consist in modifying both softwares.

The invention claimed is:

1. A PCMCIA card for remotely downloading flight data via a wireless network to a ground station, the PCMCIA card being configured to be connected to an ACMS system of an aircraft, the ACMS system recording said flight data and generating an ACMS report after at least one predefined condition has been satisfied, the ACMS report comprising several pieces of information said PCMCIA card comprising

- a communication unit configured to transfer said flight data to the ground station, the communication unit comprising a transmitter;
- a storage unit connected to the communication unit, the storage unit being configured to store said flight data and said ACMS report;

wherein the storage unit stores a set of configuration data of a flight data transfer;

a communication control unit which operates to inhibit the transmitter of the communication unit under predetermined conditions;

the communication unit comprises a processor configured to;

i) detect whether said ACMS report has been generated, ii) compare the information of the ACMS report to said set of configuration data; and iii) depending on a result of the comparison, automatically trigger the flight data transfer, according to the configuration data, from said communication unit to the ground station; and the communication unit receives, via the wireless network, a request to trigger the flight data transfer if said ACMS report has been generated and wherein the flight data is deleted from the storage unit after the automatic transfer of said flight data.

2. The PCMCIA card according to claim 1, wherein the communication unit automatically triggers the flight data transfer as soon as at least one information of the ACMS report is identical to a configuration data of the set of configuration data.

3. The PCMCIA card according to claim 1, wherein the communication unit automatically triggers the flight data transfer as soon as an inclusive or exclusive combination of information of said ACMS report is identical to a combination of configuration data.

4. The PCMCIA card according to claim 1, further comprising a unit for managing access to the storage unit of the PCMCIA card by the processor of the communication unit and the ACMS system.

5. The PCMCIA card according to claim 1, wherein the configuration data are: a list of possible wireless networks and/or a list of possible airports and/or a list of flight data to be transferred and/or a compression rate to be applied to the flight data and/or an encryption type to be applied to the flight data and/or a roaming activation.

6. The PCMCIA card according to claim 1, wherein the wireless network is a cellular network or a dedicated architecture mobile network of the IEEE 802.11 or IEEE 802.16.

7. The PCMCIA card according to claim 1, wherein the wireless network is a cellular network and wherein as an alternative to the automatic transfer at the end of the flight, the transfer is triggered by the receipt of a SMS message.

8. The PCMCIA card according to claim 1, wherein a communication control unit is configured to receive from the ACMS system at least one flight datum in order to determine whether the transmitter of the communication unit has to be inhibited.

9. The PCMCIA card according to claim 1, comprising an interface configured to connect said PCMCIA card to an ACMS system of an aircraft, the interface being a PCMCIA, USB, PCI, PCI express interface.

* * * * *